US009879843B2

(12) United States Patent
Xu et al.

(10) Patent No.: US 9,879,843 B2
(45) Date of Patent: Jan. 30, 2018

(54) LED-BASED PERSONAL AND OTHER LIGHTING DEVICES AND SYSTEMS

(71) Applicant: Axlen, Inc., Wilmington, DE (US)

(72) Inventors: Li Xu, Saratoga, CA (US); Bo Pi, Carlsbad, CA (US); Anthony Hsu, Saratoga, CA (US)

(73) Assignee: Axlen, Inc., Wilmington, DE (US)

( * ) Notice: Subject to any disclaimer, the term of this patent is extended or adjusted under 35 U.S.C. 154(b) by 283 days.

(21) Appl. No.: 14/424,976

(22) PCT Filed: Aug. 29, 2013

(86) PCT No.: PCT/US2013/057421
§ 371 (c)(1),
(2) Date: Feb. 27, 2015

(87) PCT Pub. No.: WO2014/036342
PCT Pub. Date: Mar. 6, 2014

(65) Prior Publication Data

US 2015/0267898 A1 Sep. 24, 2015

Related U.S. Application Data

(60) Provisional application No. 61/694,737, filed on Aug. 29, 2012.

(51) Int. Cl.
*F21V 9/14* (2006.01)
*F21V 14/00* (2006.01)
(Continued)

(52) U.S. Cl.
CPC ..... *F21V 14/003* (2013.01); *F21K 9/65* (2016.08); *F21S 6/002* (2013.01); *F21S 8/033* (2013.01);
(Continued)

(58) Field of Classification Search
CPC ..... F21V 14/003; F21V 29/70; F21V 1/06; F21V 7/18; F21V 9/14; F21V 21/26;
(Continued)

(56) References Cited

U.S. PATENT DOCUMENTS 5,345,282 A 9/1994 Ushiro et al.
2004/0114357 A1 6/2004 Dalton et al.
(Continued)

FOREIGN PATENT DOCUMENTS

JP 3176039 U 5/2012
KR 101008971 B1 * 1/2011
WO 2012070904 A2 5/2012

*Primary Examiner* — Elmito Breval
*Assistant Examiner* — Glenn Zimmerman
(74) *Attorney, Agent, or Firm* — Perkins Coie LLP

(57) ABSTRACT

Lighting systems, devices and techniques are provided to construct solid-state lighting devices and systems that provide energy-efficient illumination, including personal lighting devices, desktop lighting devices, and ceiling/overhead lighting devices based on semiconductor-based solid-state light sources such as LEDs or laser diodes. The disclosed solid-state lighting devices and systems use an illumination plate to receive the generated light from one or more LEDs or laser diodes and to process the received light to exhibit desired spatial distribution of light power across the illumination plate and desired direction of the output light from the illumination plate.

23 Claims, 13 Drawing Sheets

(51) Int. Cl.

| | |
|---|---|
| ***F21S 6/00*** | (2006.01) |
| ***F21V 1/06*** | (2006.01) |
| ***F21V 7/18*** | (2006.01) |
| ***F21V 29/70*** | (2015.01) |
| ***F21S 8/00*** | (2006.01) |
| ***F21V 21/26*** | (2006.01) |
| ***F21V 23/02*** | (2006.01) |
| ***F21K 9/65*** | (2016.01) |
| *F21Y 105/10* | (2016.01) |
| *F21Y 115/10* | (2016.01) |

(52) U.S. Cl.
CPC ..... *F21V 1/06* (2013.01); *F21V 7/18* (2013.01); *F21V 9/14* (2013.01); *F21V 21/26* (2013.01); *F21V 23/023* (2013.01); *F21V 29/70* (2015.01); *F21Y 2105/10* (2016.08); *F21Y 2115/10* (2016.08)

(58) Field of Classification Search
CPC ..... F21V 23/023; F21K 9/65; F21S 6/002; F21S 8/033; F21Y 2105/10; F21Y 2115/10
USPC ..... 362/19, 612, 618, 352, 351
See application file for complete search history.

(56) References Cited

U.S. PATENT DOCUMENTS

| | | | | |
|---|---|---|---|---|
| 2006/0250820 | A1* | 11/2006 | Kuo | G02B 6/0031 362/623 |
| 2008/0049446 | A1* | 2/2008 | Harbers | G02B 6/0073 362/612 |
| 2011/0227895 | A1* | 9/2011 | Takahashi | G02B 6/0061 345/211 |
| 2012/0307518 | A1* | 12/2012 | Lee | G02F 1/133615 362/602 |
| 2014/0268775 | A1* | 9/2014 | Kennemer | F21L 14/00 362/249.03 |

* cited by examiner

*(Type 1-polarization based)*

*(type 1-polarization based)*

(type 2-diffuser)

*(type 2-diffuser)*

*(type 2-diffuser)*

(type 2-diffuser)

(type 3-distributed diffuser spots)

(type 3-distributed diffuser spots)

LED-BASED PERSONAL AND OTHER LIGHTING DEVICES AND SYSTEMS

CROSS REFERENCE TO RELATED APPLICATION

This patent document is a 35 U.S.C. §371 National Stage application of PCT Application No. PCT/US2013/057421, filed on Aug. 29, 2013, which claims the priority and benefits of U.S. Provisional Application No. 61/694,737, entitled "LED-BASED PERSONAL AND OTHER LIGHTING DEVICES AND SYSTEMS," filed on Aug. 29, 2012. The entire content of the before-mentioned patent application is incorporated by reference as part of the disclosure of this application.

TECHNICAL FIELD

This patent document relates to lighting systems, devices, and techniques, including designs and operations of lighting devices and systems based on semiconductor light-emitting diodes or laser diodes.

BACKGROUND

A light-emitting diode (LED) is a semiconductor light source. An LED includes semiconducting materials doped with impurities to create a p-n junction, in which electrical current can easily flow one directionally from the p-side (anode) to the n-side (cathode), but not in the reverse direction. Charge-carriers (e.g., electrons and holes) flow into the p-n junction from connecting electrodes at each end of the junction having different voltages. For example, when an electron combines with a hole, the electron falls into a lower energy level and can release energy in the form of a photon, e.g., emitting light. This effect is referred to as electroluminescence. The wavelength of the light emitted, and thus the color of the emitted light, depends on the band gap energy of the materials forming the p-n junction. For example, bright blue LEDs are based on the wide band gap semiconductors including GaN (gallium nitride) and InGaN (indium gallium nitride). For producing white light using LEDs, one technique is to use individual LEDs that emit three primary colors (red, green, and blue) and then mix all the colors to form white light. Another technique is to use a phosphor material to convert monochromatic light from a blue or ultraviolet LED to broad-spectrum white light, e.g., in a similar manner to fluorescent light bulbs.

Semiconductor LEDs and semiconductor laser diodes (LDs) are known for their energy efficiency in converting electricity into light and can be used to construct energy-efficient lighting sources or devices for a wide range of applications. For example, LEDs have been adopted in various lighting devices to replace or substitute fluorescent and candescent lights. LED lighting devices can be designed based on DC power supplies such as batteries or AC power supply.

SUMMARY

Lighting techniques, devices and systems are provided to construct solid-state lighting devices and systems to provide energy-efficient illumination including personal lighting devices, desktop lighting devices, and ceiling/overhead lighting devices based on semiconductor-based solid-state light sources such as LEDs or laser diodes.

In one aspect, a lighting device based on semiconductor light-emitting diodes (LEDs) includes an illumination plate including an LED module having LEDs that emit visible light, an optical plate module including a transparent slab having top and bottom surfaces and a light input side facet between the top and bottom surfaces engaged to the LED module to receive visible light from the LED module, and an optical layer formed on the top surface of the transparent slab to be optically transparent or optically reflective to light inside the transparent slab; a support plate having a top plate end and a bottom support end, the top support end being engaged to the illumination plate to allow the support plate and the illumination plate to pivot at different positions relative to each other; and a base plate engaged to the bottom support end of the support plate to allow the support plate and the base plate to pivot at different positions relative to each other, in which the illumination plate, the support plate and base plate collectively form a reconfigurable lighting structure that enables a configuration where the base plate operates as a base to allow the support plate to position the illumination plate over the base plate as a desktop lighting device.

Implementations of the lighting device can optionally include one or more of the following features. For example, the support plate and the illumination plate can be engaged to enable the support plate and the illumination plate to be folded against each other, and the support plate and the base plate can be engaged to enable the support plate and the base plate to be folded against each other. For example, the base plate can include a power supply that provides electricity to energize the LED module for emitting the visible light, and the support plate can include an electrically conductive connection to electrically connect the LED module and the power supply to allow the electricity to be transferred to the LED module. For example, the optical layer can be a controllable optical layer that is responsive to a control signal to be optically transparent or optically reflective to light inside the transparent slab, and the base plate can include a control circuit that generates the control signal to the illumination plate for controlling the controllable optical reflector layer. For example, the controllable optical reflector layer can be configured to be (1) optically transparent when the power to the LED module is off and (2) optically reflective when the power to the LED module is on. For example, the support plate and the illumination plate can be engaged to enable the support plate and the illumination plate to be folded against each other, and the support plate and the base plate can be engaged to enable the support plate and the base plate to be folded against each other, and the controllable optical reflector layer can be controlled to be optically transparent when the illumination plate, the support plate and the base plate are folded together. For example, the support plate can be made of a transparent or translucent material and can include a transparent electrically conductive material to provide the electrically conductive connection. For example, the power supply in the base plate can be structured to include one or more batteries. For example, the illumination plate can include an optically reflective layer around side edge of the transparent slab to reflect light incident to the edge back to the transparent slab to increase light output at the top or bottom surface. For example, the illumination plate can include a metal part in contact with the LED module to dissipate heat out of the LED module.

In another aspect, a lighting device based on semiconductor LEDs includes an LED module having LEDs that emit visible light, a transparent slab having top and bottom surfaces and an input side facet and additional side facets between the top and bottom surfaces, the transparent slab being coupled to the LED module via the input side facet to receive visible light from the LED module, one or more side facet films formed on the additional side facets of the transparent slab to reflect light exiting the transparent slab via the additional side facets back to the transparent slab so as to enable the transparent slab to direct the received light out of the transparent slab via the top and bottom surfaces, an optical layer formed on the top surface of the transparent slab to be between (1) a first optical state that is optically transparent or translucent to light in the transparent slab and (2) a second optical state that is optically reflective to light in the transparent slab, and a lighting control mechanism that is coupled to control output of light from the transparent slab based on the first and second optical states of the optical layer with respect to the light inside the transparent slab to either output light via both top and bottom surfaces when the optical layer is in the first optical state to the light or to output light via only the bottom surface when the optical layer is in the second optical state to the light.

Implementations of the lighting device can optionally include one or more of the following features. For example, the optical layer can include a stack of dielectric films configured to transmit light in a first optical polarization and to reflect light in a second polarization that is orthogonal to the first optical polarization, and the lighting control mechanism can be configured to control an optical polarization of light inside the transparent slab to be in either the first optical polarization or in the second polarization. For example, the optical layer can be configured as a controllable optical layer that changes between the first and second optical states in response to a control signal applied to the controllable optical reflector layer, and the lighting control mechanism can be coupled to the optical layer to supply the control signal. For example, the controllable optical layer can include a liquid crystal layer that responds to an applied voltage as the control signal to change between the first and second optical states. In some implementations, for example, the controllable optical layer can be configured as a controllable optical diffuser structured to include a top transparent electrode, a light diffusing layer that is below the top transparent electrode that responds to an applied voltage as the control signal to change an amount of diffusion of light based on the applied voltage, and a bottom transparent electrode formed below the light diffusing layer which is located between the bottom and top transparent electrodes. In some implementations, for example, the controllable optical layer can be configured as a controllable optical reflector structured to include a top polarization selective reflector configured to transmit light in a first optical polarization and to reflect light in a second polarization that is orthogonal to the first optical polarization, a liquid crystal layer that is formed below the top polarization selective reflector that responds to an applied voltage as the control signal to change optical polarization between the first and second optical polarizations, and a bottom polarization selective reflector formed on top of the top surface of the transparent slab and configured to transmit light in the first optical polarization and to reflect light in the second polarization that is orthogonal to the first optical polarization. For example, each polarization selective reflector can be configured to include a stack of dielectric films. In some implementations, for example, the lighting device can include a battery power supply to supply electricity to the LED module for emitting the visible light. In some implementations, for example, the lighting device can include a mounting unit for mounting the lighting device to a wall or other surface. In some examples, the LED module and the transparent plate can be engaged to form an illumination plate with LED module being on a first end of the illumination plate; and the lighting device can be structured to further include a support plate having a top plate end and a bottom support end, the top support end being engaged to the illumination plate to allow the support plate and the illumination plate to pivot at different positions relative to each other, and a base plate engaged to the bottom support end of the support plate to allow the support plate and the base plate to pivot at different positions relative to each other, in which the illumination plate, the support plate and base plate collectively form a reconfigurable lighting structure that enables a configuration where the base plate operates as a base to allow the support plate to position the illumination plate over the base plate as a desktop lighting device. For example, the support plate and the illumination plate can be engaged to enable the support plate and the illumination plate to be folded against each other, and the support plate and the base plate are engaged to enable the support plate and the base plate to be folded against each other. In some implementations, for example, the base plate can include a power supply that provides electricity to energize the LED module for emitting the visible light, and the support plate can include an electrically conductive connection to electrically connect the LED module and the power supply to allow the electricity to be transferred to the LED module. In some implementations, for example, the optical layer can be configured as a controllable optical layer that is responsive to a control signal to be optically transparent or optically reflective to light inside the transparent slab, the lighting control mechanism can be coupled to the optical layer to supply the control signal, and the base plate can include a control circuit that generates the control signal to the illumination plate for controlling the controllable optical reflector layer.

Various features are described in detail in the drawings, the description, and the claims.

DETAILED DESCRIPTION

Figure 1:
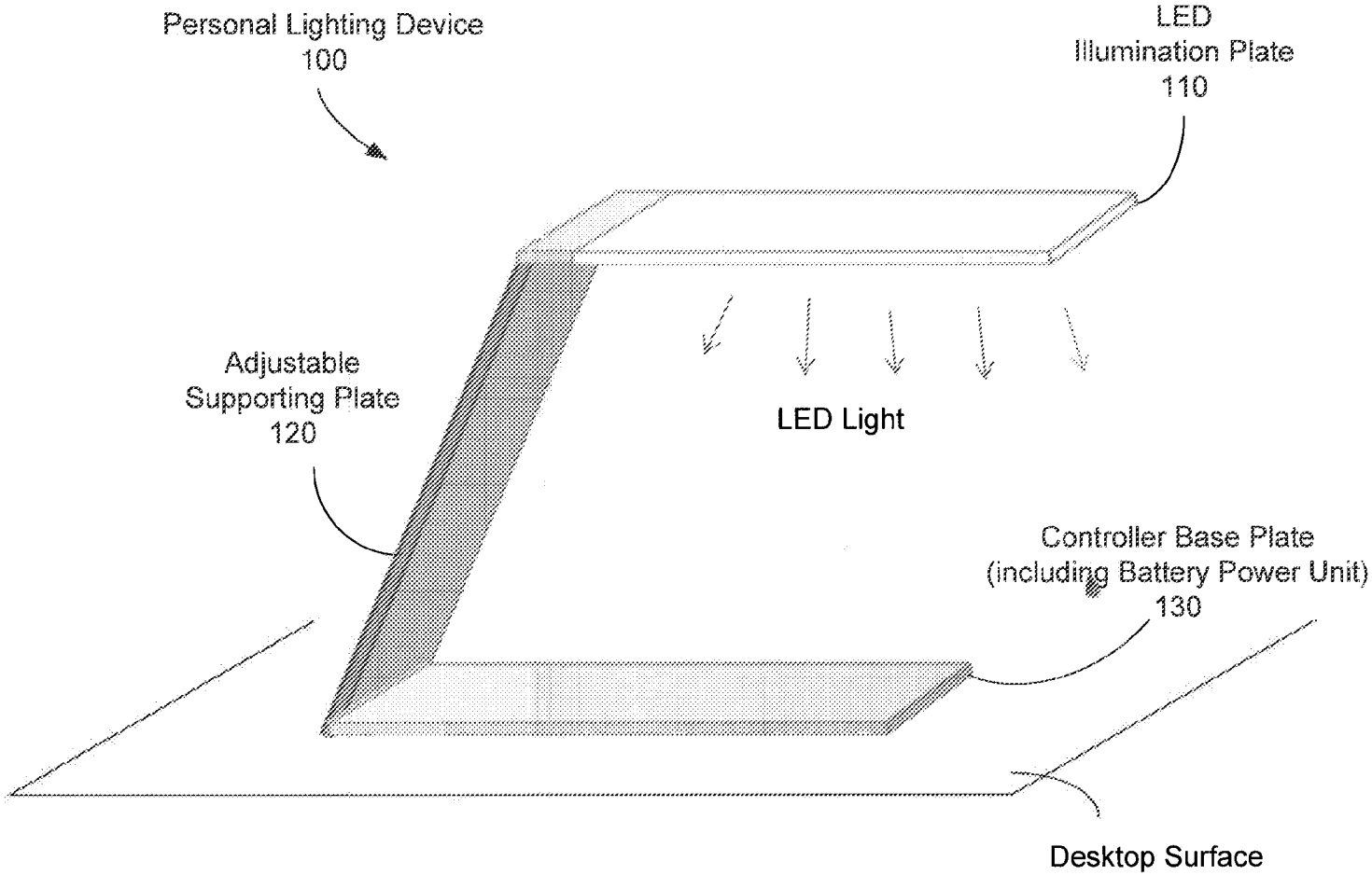
FIGS. 1 and 2 show diagrams of an exemplary reconfigurable personal lighting device based on an exemplary LED-based illumination plate of the disclosed technology.

The described examples of lighting techniques, systems, and devices based on semiconductor-based solid-state light sources such as LEDs or laser diodes use an illumination plate to receive the generated light from one or more LEDs or laser diodes and to process the received light to exhibit desired spatial distribution of light power across the illumination plate and desired direction of the output light from the illumination plate. This illumination plate operates as the "lighting engine" of the exemplary personal lighting devices and systems described in this patent document.

In one aspect, a lighting device based on semiconductor light-emitting diodes (LEDs) includes an illumination plate, a support plate having a top plate end and a bottom support end, the top support end being engaged to the illumination plate to allow the support plate and the illumination plate to pivot at different positions relative to each other, and a base plate engaged to the bottom support end of the support plate to allow the support plate and the base plate to pivot at different positions relative to each other, in which the illumination plate, the support plate and base plate collectively form a reconfigurable lighting structure that enables a configuration where the base plate operates as a base to allow the support plate to position the illumination plate over the base plate as a desktop lighting device.

In some implementations, for example, this illumination plate can be constructed to include an LED module having LEDs that emit visible light, an optical plate module including a transparent slab having top and bottom surfaces and a light input side facet between the top and bottom surfaces engaged to the LED module to receive visible light from the LED module, and an optical layer formed on the top surface of the transparent slab to be optically transparent or optically reflective to light inside the transparent slab. The optically transparent or optically reflective property of the optical layer formed on the top surface can be controlled by either controlling the polarization of light incident to the top optical layer or to control the top optical layer itself so the top optical layer can be either optically transparent or optically reflective while directing light in the illumination plate to exit as output light at the bottom surface of the illumination of the plate. This property of the two optical states of the top optical layer of the illumination plate can be implemented in various configurations as described further in this document.

Implementations of the lighting device can optionally include one or more of the following features. For example, the support plate and the illumination plate can be engaged to enable the support plate and the illumination plate to be folded against each other, and the support plate and the base plate can be engaged to enable the support plate and the base plate to be folded against each other. For example, the base plate can include a power supply that provides electricity to energize the LED module for emitting the visible light, and the support plate can include an electrically conductive connection to electrically connect the LED module and the power supply to allow the electricity to be transferred to the LED module. For example, the optical layer can be a controllable optical layer that is responsive to a control signal to be optically transparent or optically reflective to light inside the transparent slab, and the base plate can include a control circuit that generates the control signal to the illumination plate for controlling the controllable optical reflector layer. For example, the controllable optical reflector layer can be configured to be (1) optically transparent when the power to the LED module is off and (2) optically reflective when the power to the LED module is on. For example, the support plate and the illumination plate can be engaged to enable the support plate and the illumination plate to be folded against each other, and the support plate and the base plate can be engaged to enable the support plate and the base plate to be folded against each other, and the controllable optical reflector layer can be controlled to be optically transparent when the illumination plate, the support plate and the base plate are folded together. For example, the support plate can be made of a transparent or translucent material and can include a transparent electrically conductive material to provide the electrically conductive connection. For example, the power supply in the base plate can be structured to include one or more batteries. For example, the illumination plate can include an optically reflective layer around side edge of the transparent slab to reflect light incident to the edge back to the transparent slab to increase light output at the top or bottom surface. For example, the illumination plate can include a metal part in contact with the LED module to dissipate heat out of the LED module.

FIG. 1 shows an example of an LED-based personal lighting device 100 implementing the illumination plate. This device 100 includes the illumination plate 110 with an LED module and an optical plate, a support plate 120 and a base plate 130. The plates 110, 120 and 130 are engaged to form a reconfigurable folding lighting structure that enables the device to operate as a desktop personal lighting device shown in FIG. 1. In this operation mode, the base plate 130 is placed on a support or desktop surface and the support plate 120 positions the illumination plate 110 over the base plate as a desktop lighting device. As illustrated, the illumination plate 110 is operated to make the top optical layer optically reflective to direct light in the illumination plate 110 to exit as output light at the bottom surface towards the area near the base plate 130.

The support plate 120 includes top plate end being engaged to the illumination plate 110 to allow the support plate 120 and the illumination plate 110 to pivot at different positions relative to each other, and a bottom support end engaged to the base plate 130 to allow the support plate 120 and the base plate 130 to pivot at different positions relative to each other. This reconfigurable folding lighting structure allows a user to adjust the position of the illumination plate 110 with respect to its lateral or horizontal position with respect to the base plate 130 and the height or vertical position of the illumination plate 110 with respect to the base plate 130.

Figure 2:
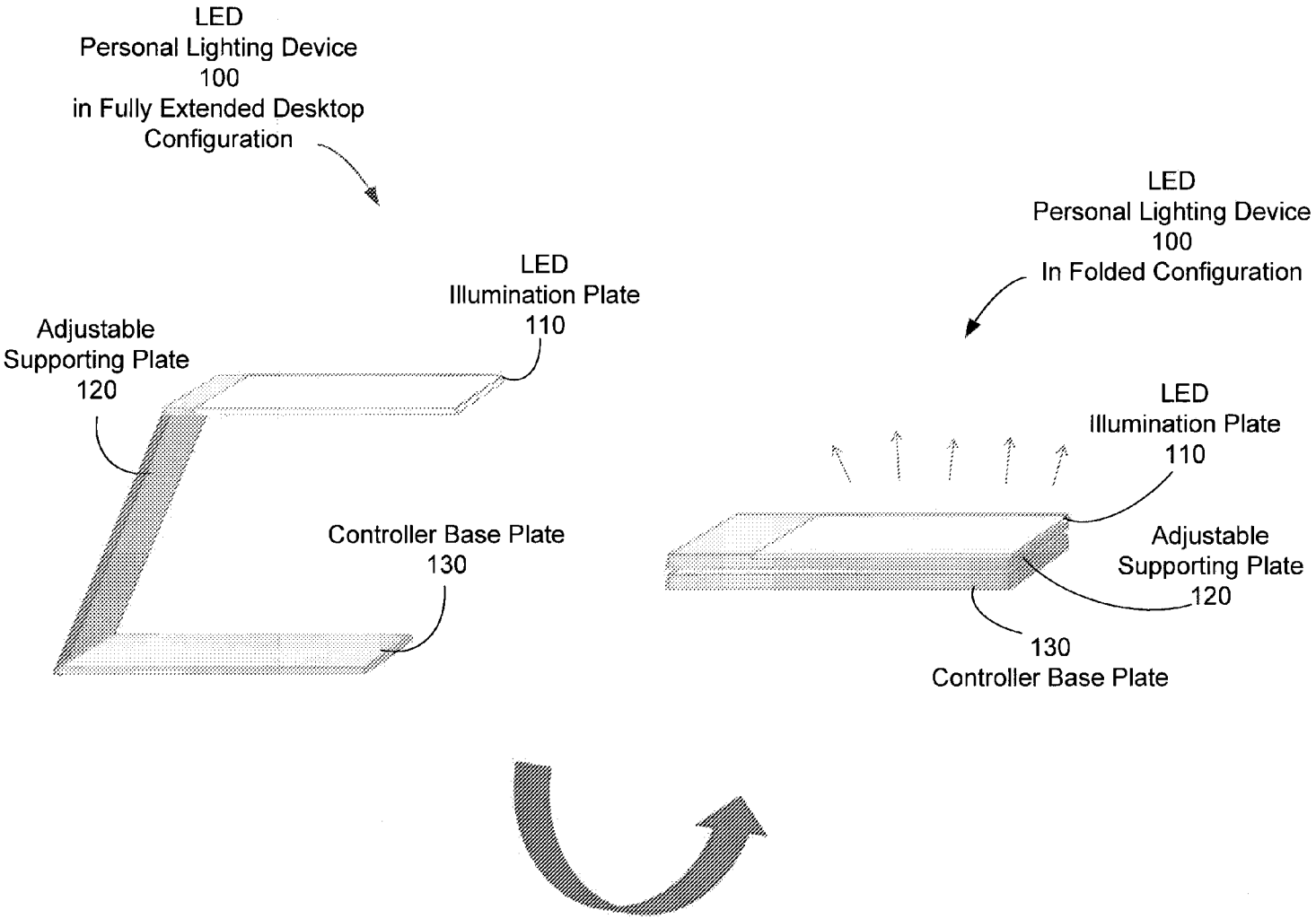

FIG. 2 shows the reconfigurable folding lighting structure of the lighting device 100 of FIG. 1 in both the fully extended desktop configuration (left) and folded configuration (right). The reconfigurable folding lighting structure provides adjustability to the user in operating the lighting device 100 based on the personal preference and provides a convenient way of folding the lighting device 100 into a relative compact form for ease of carrying by the user and portability, and for ease of storage.

One of operating options in the folded configuration is to make the top optical layer of the illumination plate 110 to be transparent so the LED light can exit from the top optical layer as a lighting device to be placed on a floor, a wall, a ceiling or other surface. This expands versatile use of the lighting device 100.

The control functions of the reconfigurable lighting device 100 can be implemented in various ways. For example, in one implementation, the base plate 130 can be designed to include a power supply that provides electricity to energize the LED module in the illumination plate 110 for emitting the visible light and the support plate 120 includes an electrically conductive connection to electrically connect the LED module in the illumination plate 110 and the power supply in the base plate 130 to allow the electricity to be transferred to the LED module. When the top optical layer in the illumination plate 110 is a controllable optical layer that is responsive to a control signal to be optically transparent or optically reflective to light inside the transparent slab, the base plate 110 can include a control circuit that generates the control signal to the illumination plate 110 for controlling the controllable optical reflector layer. In other implementations, the control functions may be implemented in the top of the illumination plate 110 or the side of the support plate 120.

The middle support plate 120 may also be made of a transparent material so that the top illumination plate 110 can appear to be suspended in the air to make the device 100 more appealing to certain consumers. When electrically conductive paths need to run through the support plate 120, e.g., when the power supply and control are placed in the base plate 130, conductive transparent material can be used to form the conductive paths.

Figure 3:
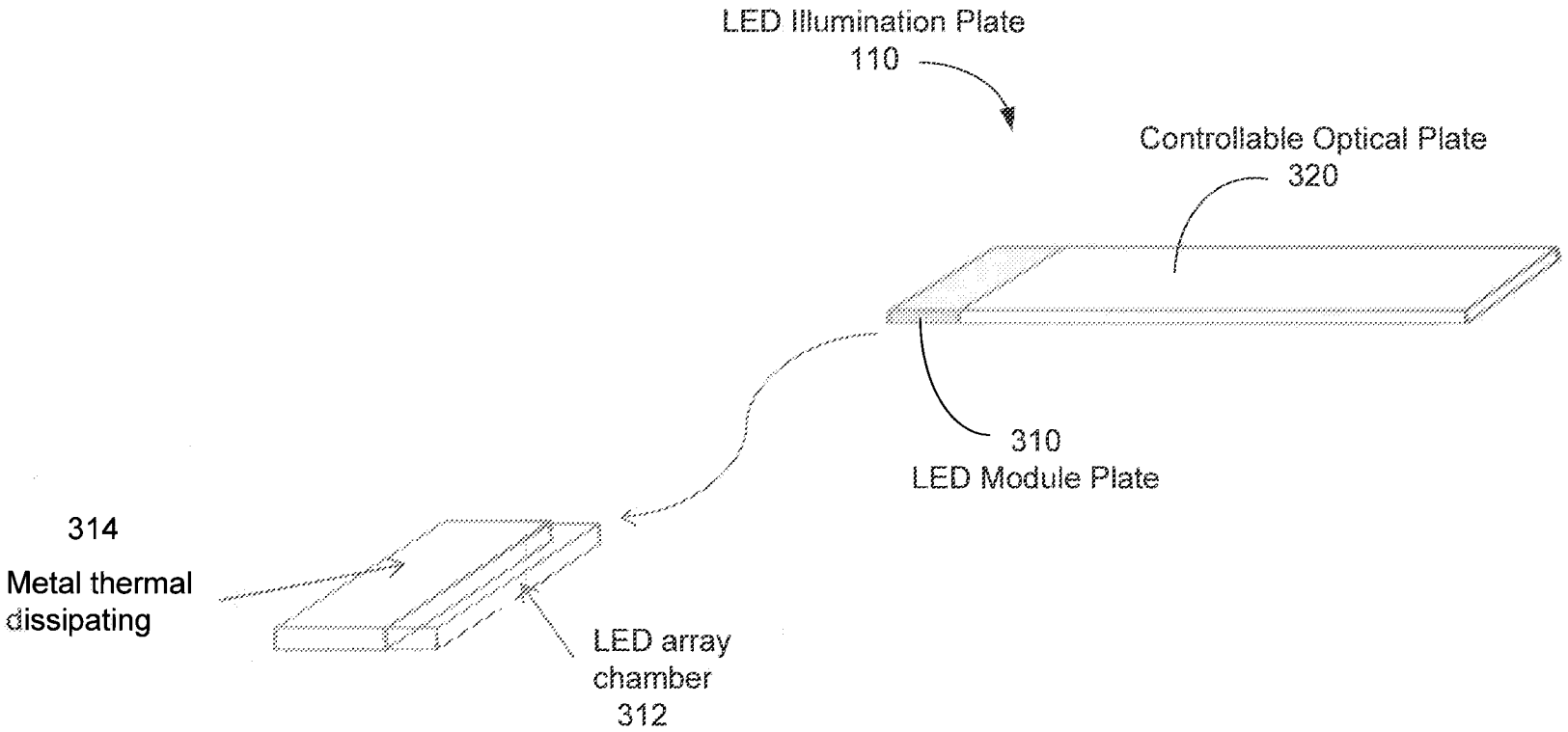
FIGS. 3 and 4 show diagrams illustrating exemplary embodiments of the LED-based illumination plate.
Figure 4:
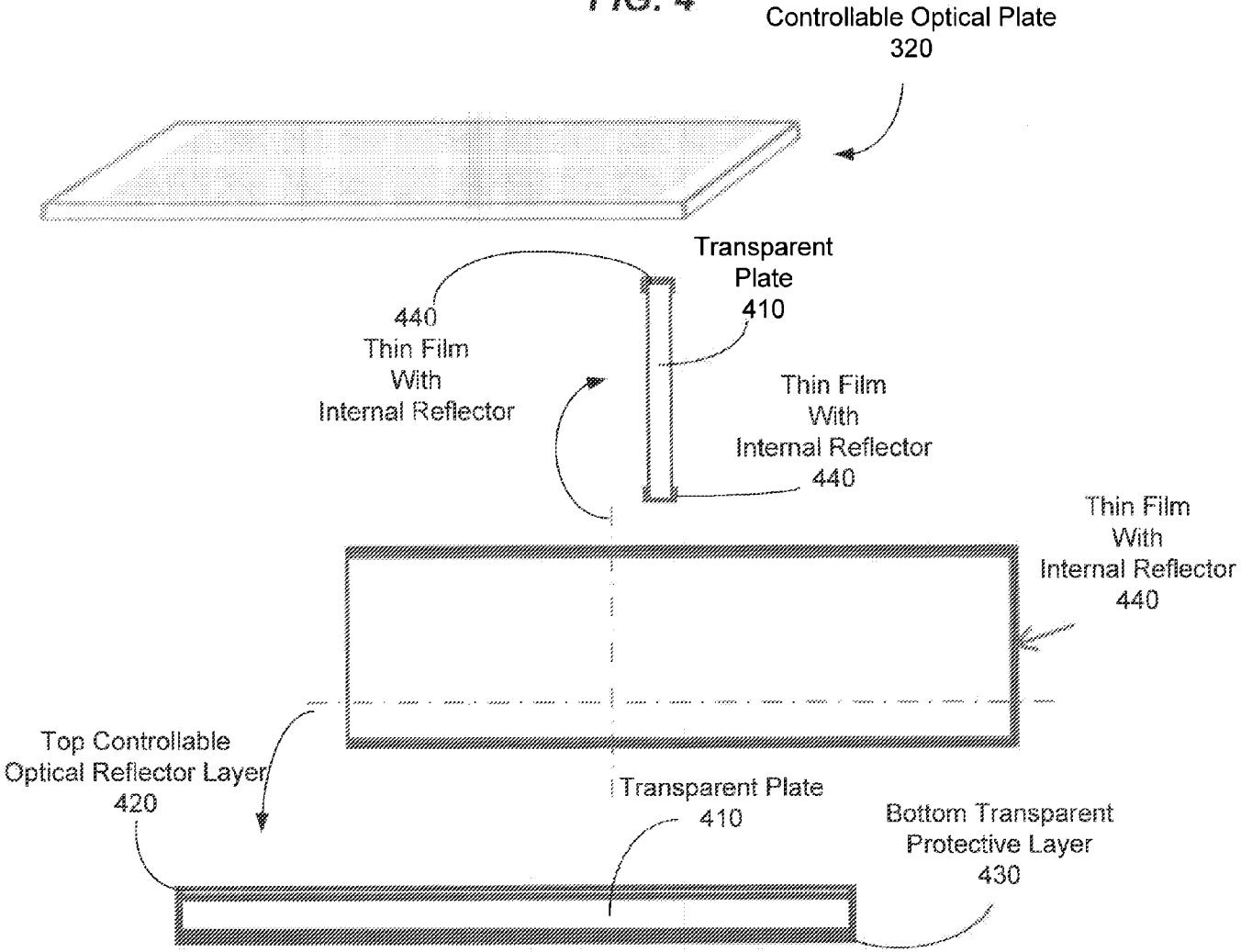

The illumination plate 110 in FIG. 1 can be implemented in various configurations. FIGS. 3 and 4 show some details of exemplary implementations of the illumination plate 110 shown in FIG. 1.

In FIG. 3, an example of the illumination plate 110 is shown to include an LED module 310 in form of an end plate and an optical plate 320 coupled to the LED module 310 at one end. The LED light produced by the LED module 310 is coupled into the optical plate 320. The optical plate 320 operates as an optical waveguide to spatially mix the LED light to have a more spatially uniform distribution of optical power across the optical plate 320. As such, the output light from the optical plate 320 has a spatially uniform appearance in optical power. The LED module 310 includes an LED array chamber 312 that contains LEDs. In this example, a heat dissipating piece 314, e.g., a metal piece, is engaged to the LED array chamber 312 to extract heat out of the LED array chamber 312.

The example in FIG. 4 illustrates an exemplary implementation of the top optical layer that forms on the top surface of the illumination plate 110. In this example, the top optical layer is a top controllable optical reflector layer 420 that can be controlled to be optically transparent or optically reflective. The main body of the illumination plate 110 is a transparent plate 410 and its bottom surface is covered by a bottom transparent protective layer 430. The side surfaces of the transparent plate 410 are covered by thin films 440 where the internal surfaces of the thin films 440 form an optically reflective surface with the side surfaces of the transparent plate 410 to confine the light inside the plate 410 and enhance the output brightness from the top or bottom surface by preventing loss of light from the side surfaces.

Figure 5:
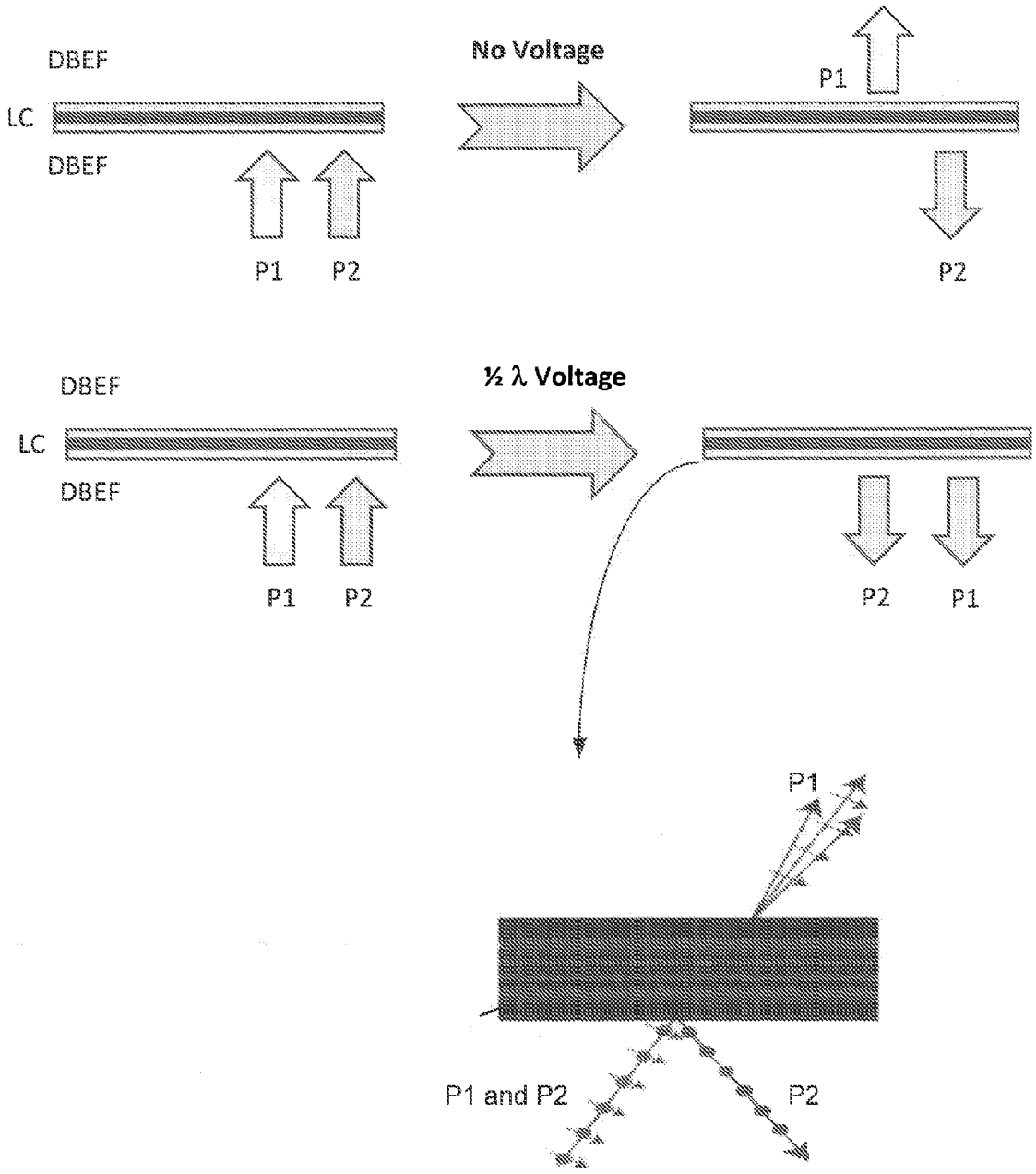
FIG. 5 shows an example of a controllable top optical layer based on polarization control of a LCD layer sandwiched between two optical polarization-selective layers.
Figure 6:
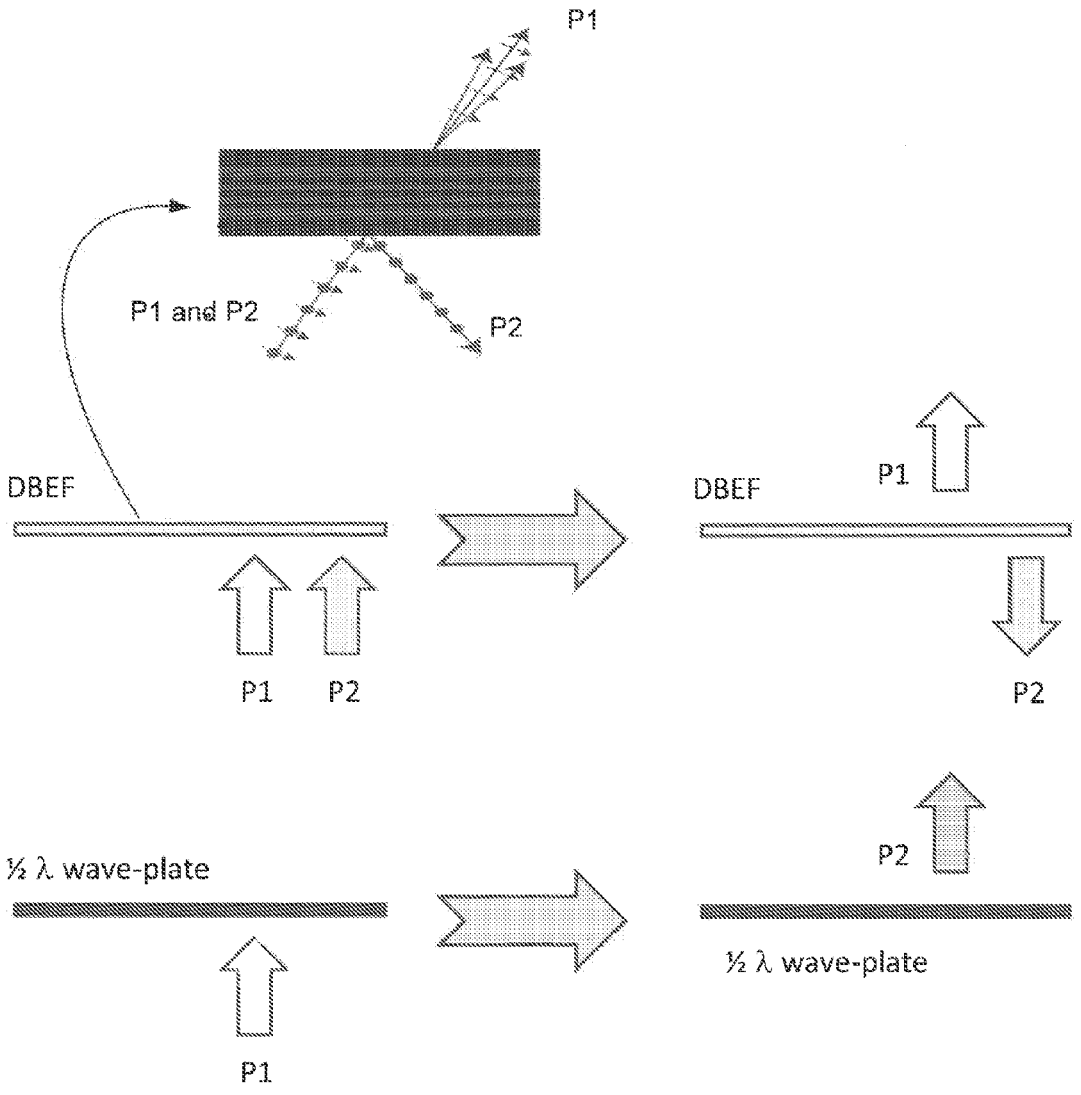
FIG. 6 shows two examples of polarization-based top optical layer for the illumination plate.
Figure 7A:
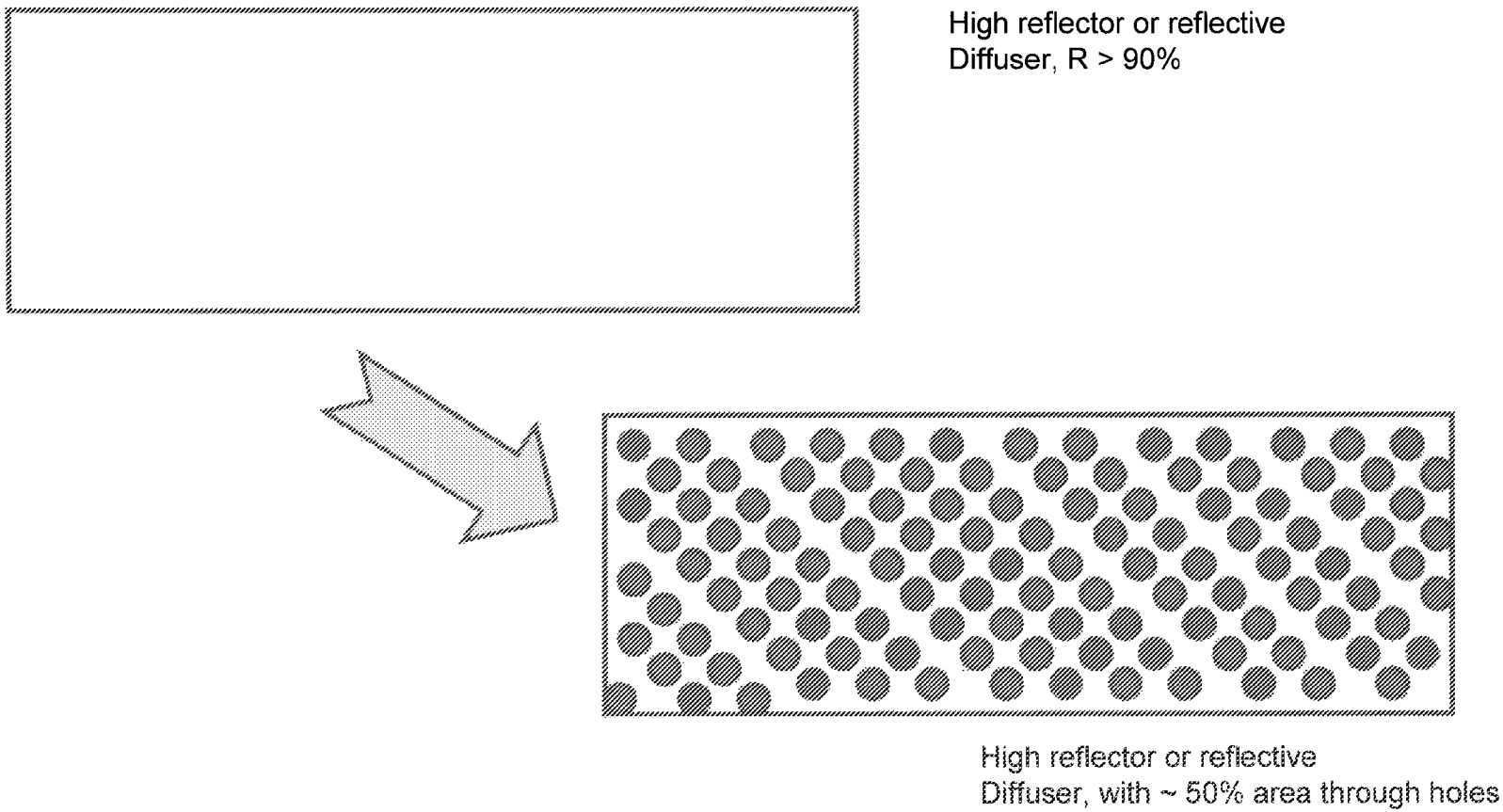
FIGS. 7A and 7B show examples of two fixed diffusion layers as the top optical layer in the illumination plate to provide the optically transparent or optically reflective state.
Figure 7B:
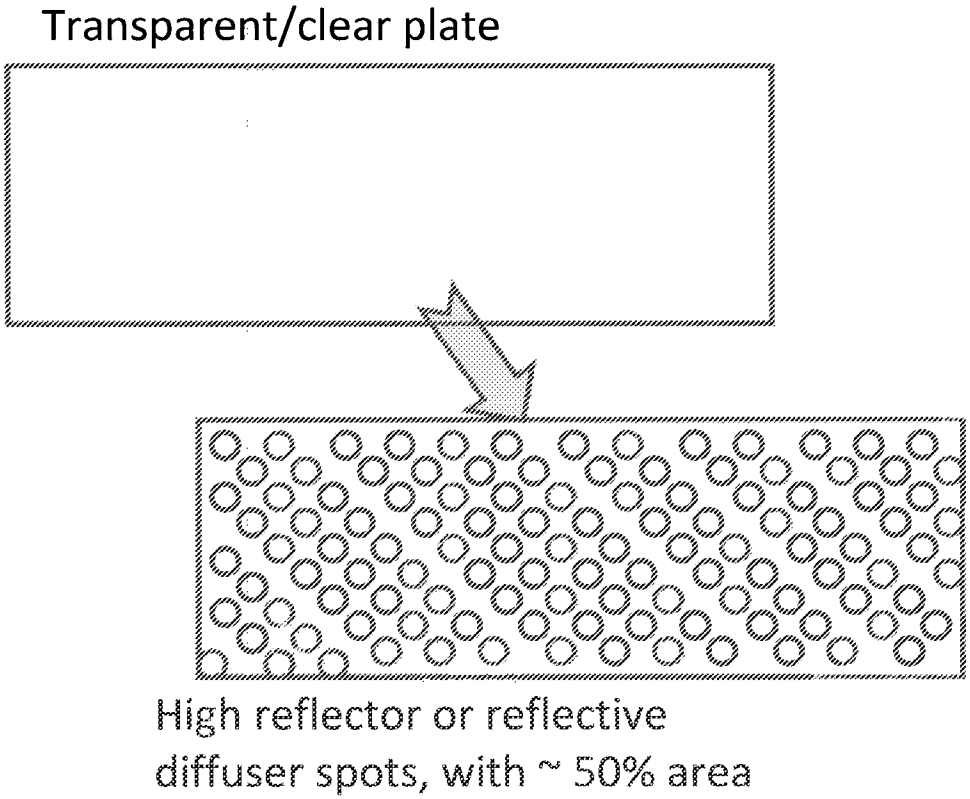
Figure 8:
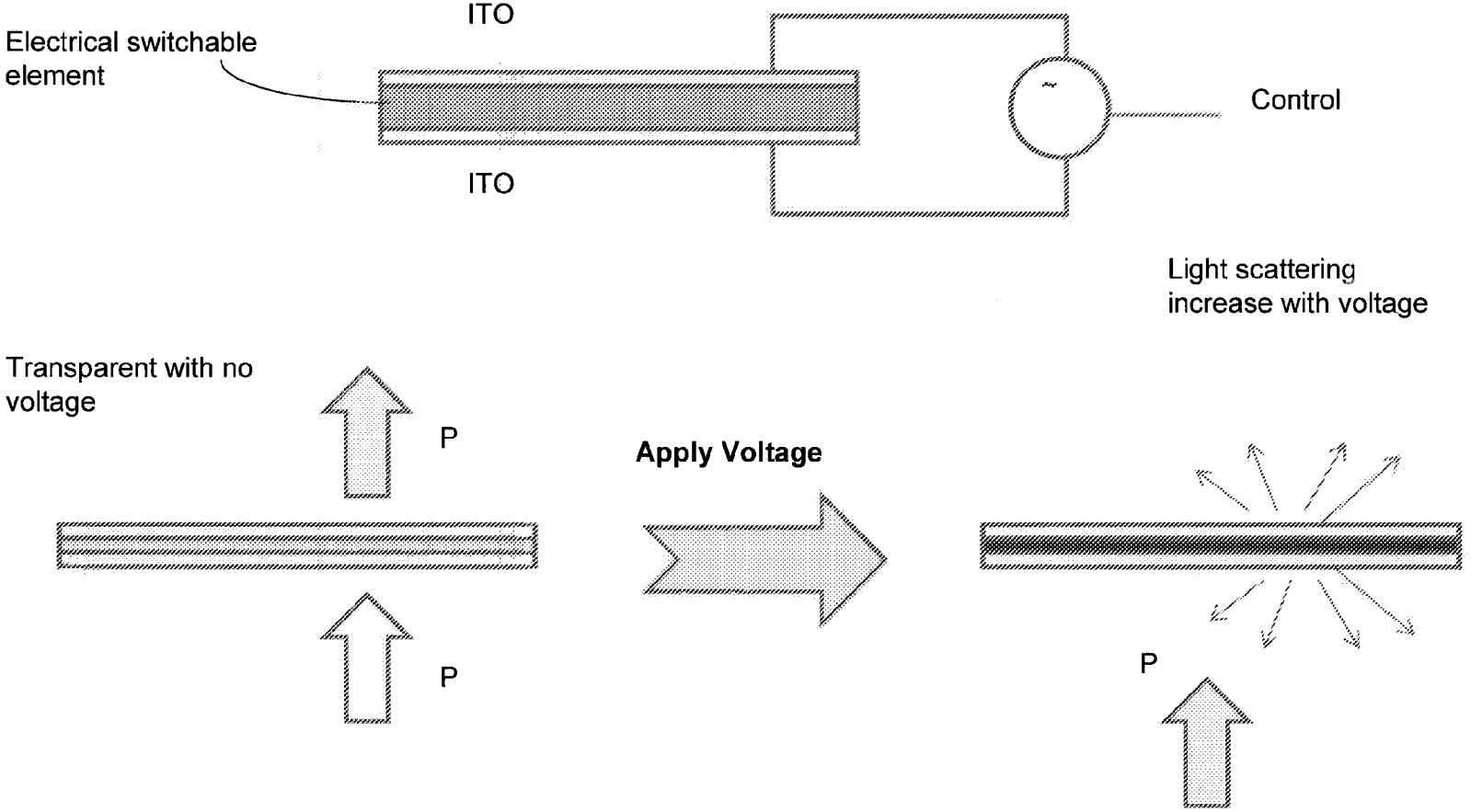
FIG. 8 shows an example of an electrically controlled diffusion layer as the top optical layer in the illumination plate to provide the optically transparent or optically reflective state.
Figure 9:
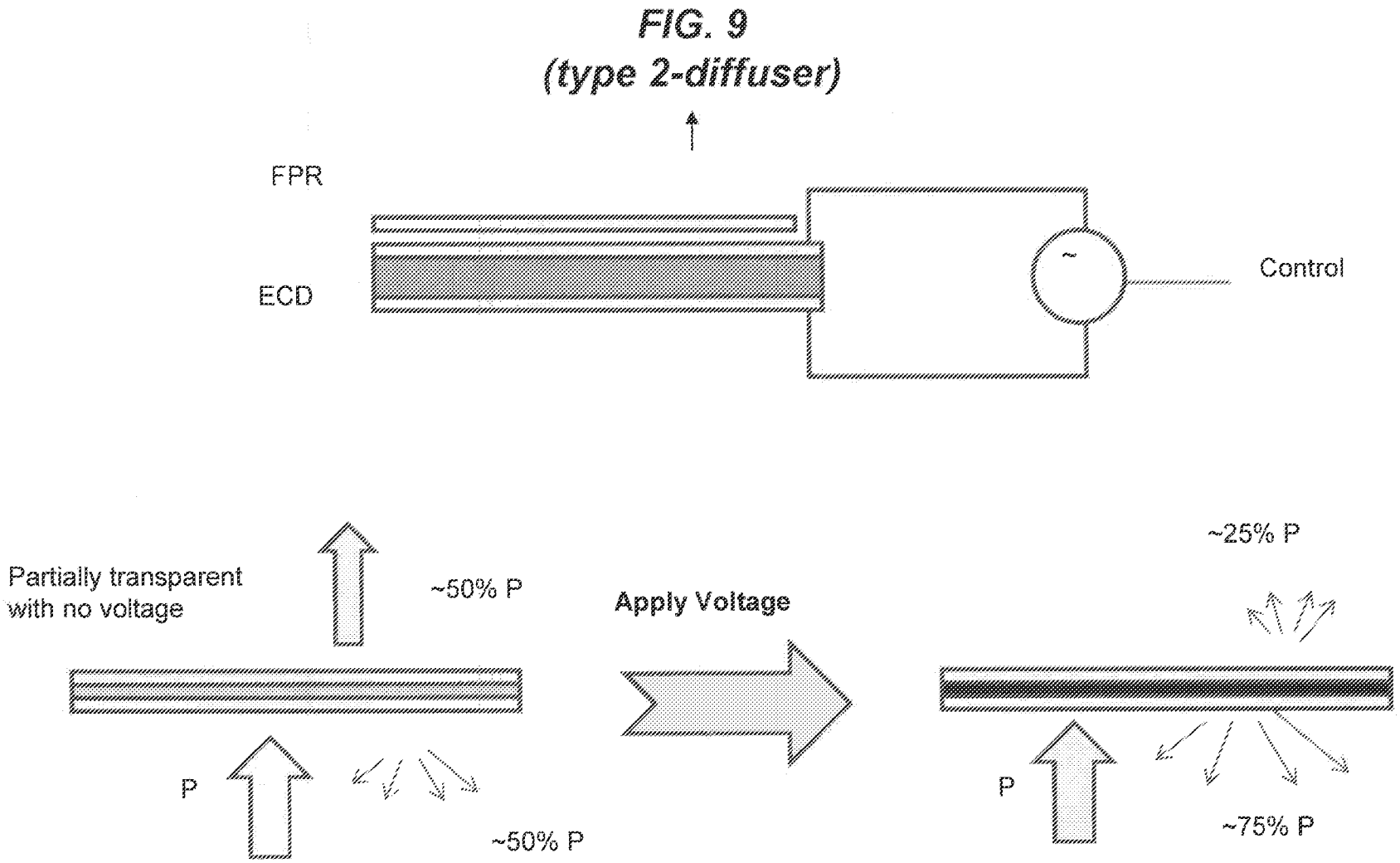
FIG. 9 shows another example of an electrically controlled diffusion layer as the top optical layer in the illumination plate to provide the optically transparent or optically reflective state.
Figure 10:
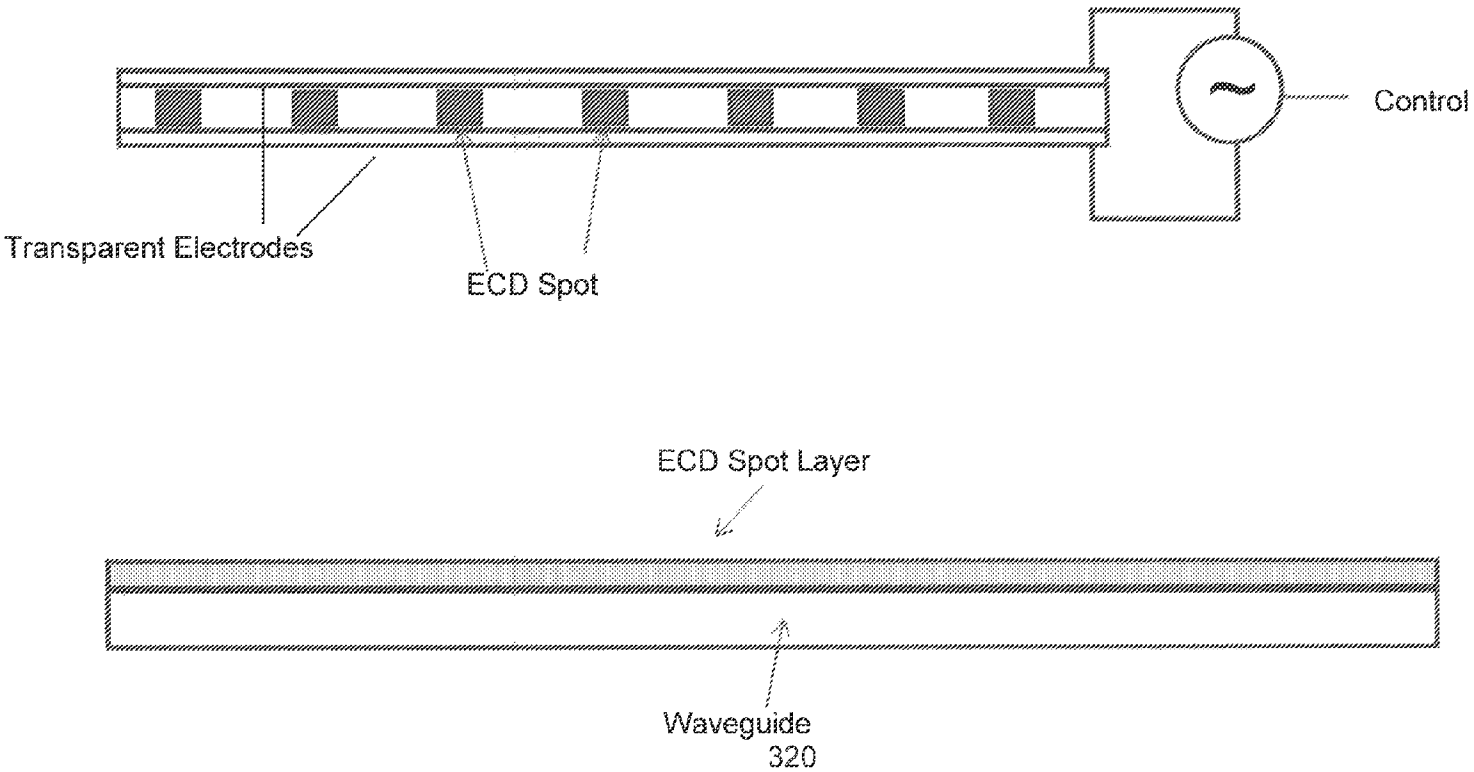
FIG. 10 shows an example for using electrically controlled spatially distributed diffuser spots between optically transparent electrodes as the top optical layer in the illumination plate to provide the optically transparent or optically reflective state.
Figure 11:
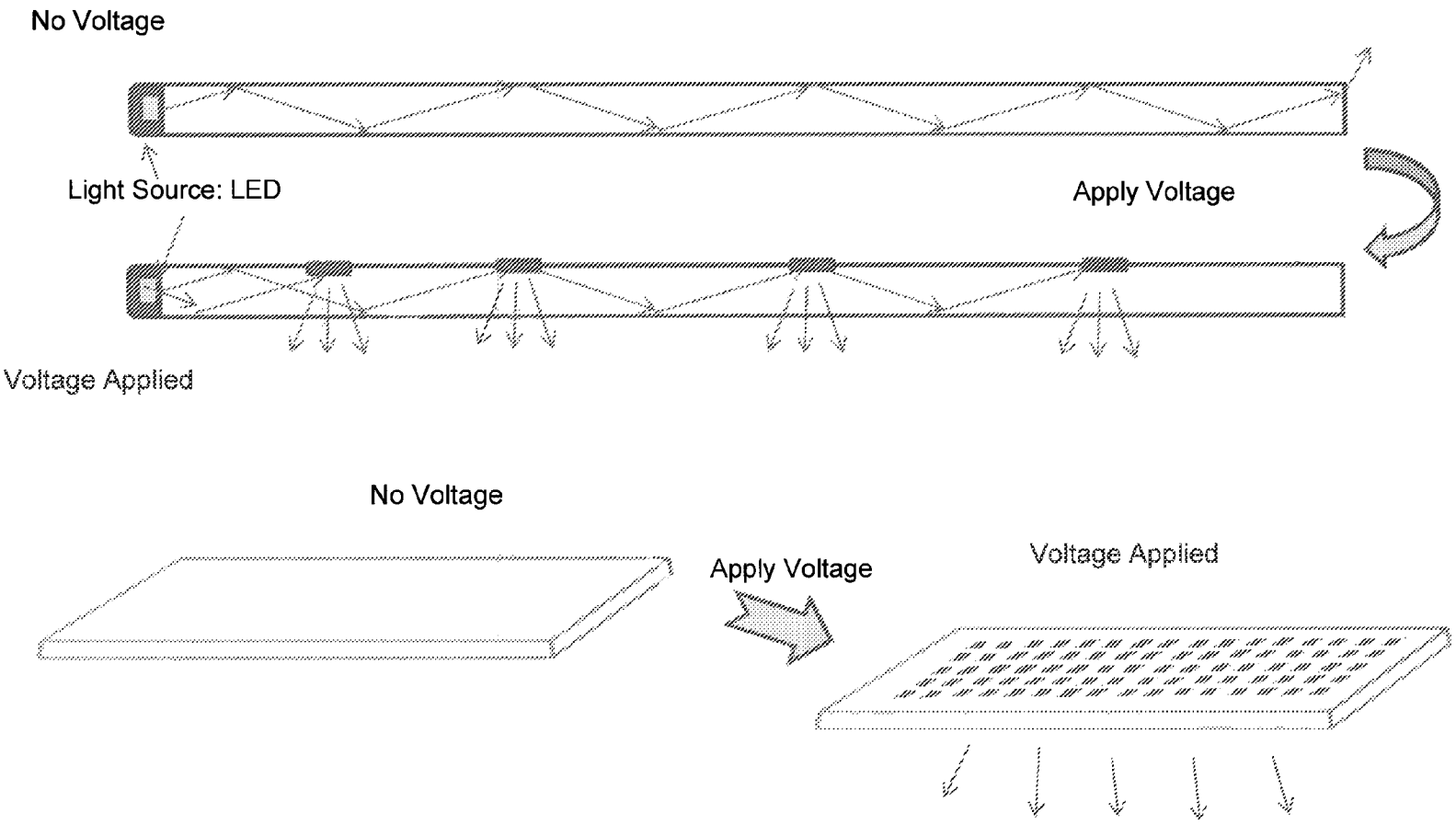
FIG. 11 shows an example of the operation of the structure in FIG. 10.

The top optical layer on the top surface of the illumination plate 110 can be implemented in various ways and some examples are provided in FIGS. 5-11. FIGS. 5 and 6 show examples of optical layers for implementing the top optical layer based on optical polarization of the light to provide the optically transparent or optically reflective state. FIGS. 7, 8 and 9 show examples of optical layers for implementing the top optical layer based on diffusion of the light to provide the optically transparent or optically reflective state. FIGS. 10 and 11 show examples of using spatially distributed diffuser spots in the illumination plate to provide the optically transparent or optically reflective state.

FIG. 5 shows an example of a controllable top optical layer based on polarization control of a LCD layer sandwiched between two optical polarization-selective layers. A control voltage is applied to the middle LCD layer to control whether or not polarized light can be transmitted through or reflected back. FIG. 5 shows an example of a first operating state for transmitting light in the first polarization P1 while reflecting light in the second, orthogonal polarization P2 when no voltage is applied to the LCD layer (top) and a second operating state for reflecting light in both polarizations P1 and P2 when a proper voltage is applied to the LCD layer (bottom). The insert in FIG. 5 shows one implementation of the optical polarization-selective layer as a multi-layer dielectric film which transmits light in one polarization P1 while reflecting light in another orthogonal polarization P1. One example of this optical polarization-selective layer multi-layer dielectric film is 3M's dual brightness enhancement film (DBEF).

FIG. 6 shows two examples of polarization-based top optical layer for the illumination plate 110. The first example uses the polarization-selective multi-layer dielectric film in the insert of FIG. 5 as the top optical layer so the two states of the layer can be achieved by controlling the optical polarization between P1 and P2 in the illumination plate. The second example is a half wave plate that transforms one polarization P1 into the orthogonal polarization P2 as the transmission output.

FIGS. 7A and 7B show examples of two fixed diffusion layers as the top optical layer in the illumination plate to provide the optically transparent or optically reflective state. In FIG. 7A, the diffusion layer includes high reflection regions that reflect light and through holes (e.g., circular shaped through holes as shown) that are spatially mixed with the high reflection regions to transmit the light (e.g., 50%). The fixed diffusion layer in FIG. 7B includes a transparent plate that includes spatially distributed high reflector or reflective diffuse spots (e.g., circular spots as shown) to transmit some light while reflecting or diffusing the remaining light (e.g., 50%).

FIG. 8 shows an example of an electrically controlled diffusion layer as the top optical layer in the illumination plate to provide the optically transparent or optically reflective state. The optical layer has a composite structure which includes an electrically switchable layer and two optically transparent electrode layers (e.g., ITO layers) coupled to a control circuit. The voltage applied on the composite structure controls the structure to be optically transparent or optically diffusive (providing some optical reflection). In the illustrated example in FIG. 8, the composite structure is transparent when no voltage is applied and becomes optically diffusive to produce reflected light when a voltage is applied.

FIG. 9 shows another example of an electrically controlled diffusion layer as the top optical layer in the illumination plate to provide the optically transparent or optically reflective state. The optical layer has a composite structure which includes an electrically switchable layer and two optically transparent electrode layers (e.g., ITO layers) coupled to a control circuit.

FIG. 10 shows an example for using electrically controlled spatially distributed diffuser spots between optically transparent electrodes as the top optical layer in the illumination plate to provide the optically transparent or optically reflective state.

FIG. 11 shows operation of the structure in FIG. 10. When no voltage is applied, the diffusion spots are optically transparent and optically invisible to light. When a voltage is applied, the diffusion spots are optically diffusive and cause optical reflection as shown.

Referring to FIG. 4, the bottom surface of the illumination plate 410 in the example in FIG. 4 is shown to have a bottom transparent protection layer 430. In implementations, the bottom surface can be a bare surface or can be a functional optical layer to enhance brightness of the output light via the bottom surface.

Figure 12:
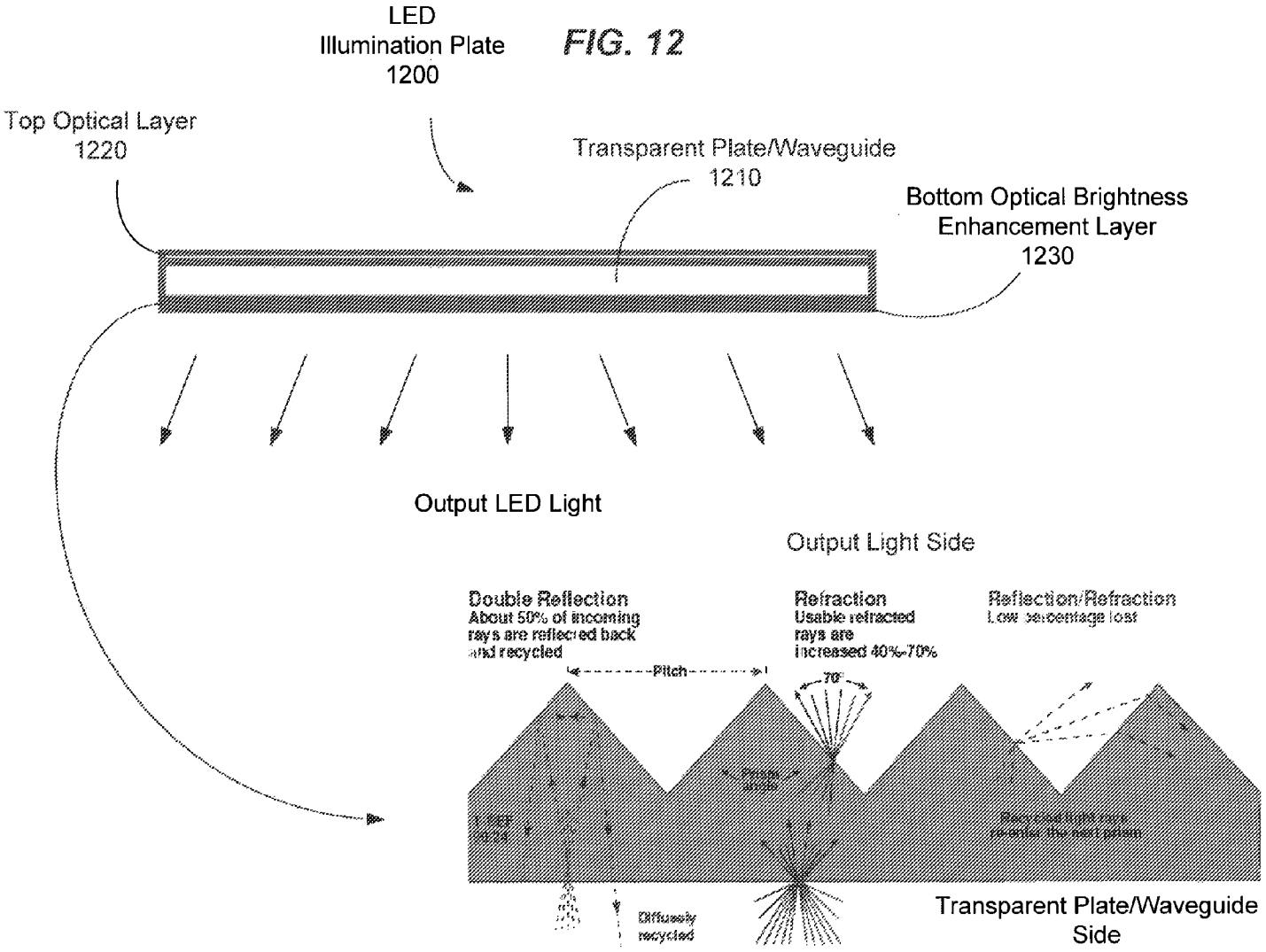
FIG. 12 shows a diagram of an exemplary illumination plate that includes a bottom optical brightness enhancement layer on the bottom surface of the transparent plate/waveguide.

As an example, FIG. 12 shows an illumination plate 1200 that includes a bottom optical brightness enhancement layer 1230 on the bottom surface of the transparent plate/waveguide 1210 similar to the transparent plate/waveguide 410 in FIG. 4. The top surface includes a top optical layer 1220 which can be implemented by various examples described above. The bottom optical brightness enhancement layer 1230 selects light rays with certain particular incident angles to transmit while redirecting most or some of other light rays back to the transparent plate 1210 as recycled light that is sent back to the layer 1230 for further selection and recycling. This feature can be used to control the directions of the transmitted light rays to provide a directional output for flood lighting and spot lighting devices and, in addition, via its recycling of the light, enhances the light brightness at the output. As illustrated in a specific example in the bottom of FIG. 12, the layer 1230 can be implemented by a brightness enhancement film (BEF) in various configurations. For example, a micro-replicated enhancement film that utilizes a prismatic structure can be used as the BEF to produce significant brightness gain and an example of the prismatic structure of such BEF. This example provides exemplary ways on how light rays are handled by the prismatic structure in selectively transmitting light rays while recycling light rays. For example, light travels in many directions and is received at the plano side of the BEF having different angles of incidence. The light that is received with a high angle of incidence reflects off the plano side and is recycled back into the light mixing chamber 103. The remaining light enters the BEF and can be reflected and refracted by the prism surface within the BEF according to Snell's Law. For example, some of the light can be reflected back by total internal reflection, while some of the light can be refracted by the prism surface at a particular direction perpendicular to the BEF, exiting the illumination plate as directional light.

The illumination plates as described above, including the example in FIG. 12, can be used in lighting devices beyond the foldable desktop personal lighting devices in FIG. 1 and can be used as ceiling lights or overhead lights. For example, a ceiling light or overhead light can use an illumination plate with the electrically controllable top optical layer to be optically transparent or optically reflective/diffusive where the top optical layer is designed to be optically transparent when the electric power to the light is off and to be optically reflective or diffusive when the electric power to the light is on. The electric power can be supplied from a battery or from a powerline.

In another aspect, a lighting device based on semiconductor LEDs is disclosed. The lighting device includes an LED module having LEDs that emit visible light. The lighting device includes a transparent slab having top and bottom surfaces and an input side facet and additional side facets between the top and bottom surfaces, in which the transparent slab is coupled to the LED module via the input side facet to receive visible light from the LED module. The lighting device includes one or more side facet films formed on the additional side facets of the transparent slab to reflect light exiting the transparent slab via the additional side facets back to the transparent slab so as to enable the transparent slab to direct the received light out of the transparent slab via the top and bottom surfaces. The lighting device includes an optical layer formed on the top surface of the transparent slab to be between (1) a first optical state that is optically transparent or translucent to light in the transparent slab and (2) a second optical state that is optically reflective to light in the transparent slab. The lighting device includes a lighting control mechanism that is coupled to control output of light from the transparent slab based on the first and second optical states of the optical layer with respect to the light inside the transparent slab to either output light via both top and bottom surfaces when the optical layer is in the first optical state to the light or to output light via only the bottom surface when the optical layer is in the second optical state to the light.

Implementations of the lighting device can optionally include one or more of the following features. For example, the optical layer can include a stack of dielectric films configured to transmit light in a first optical polarization and to reflect light in a second polarization that is orthogonal to the first optical polarization, and the lighting control mechanism can be configured to control an optical polarization of light inside the transparent slab to be in either the first optical polarization or in the second polarization. For example, the optical layer can be configured as a controllable optical layer that changes between the first and second optical states in response to a control signal applied to the controllable optical reflector layer, and the lighting control mechanism can be coupled to the optical layer to supply the control signal. For example, the controllable optical layer can include a liquid crystal layer that responds to an applied voltage as the control signal to change between the first and second optical states. In some implementations, for example, the controllable optical layer can be configured as a controllable optical diffuser structured to include a top transparent electrode, a light diffusing layer that is below the top transparent electrode that responds to an applied voltage as the control signal to change an amount of diffusion of light based on the applied voltage, and a bottom transparent electrode formed below the light diffusing layer which is located between the bottom and top transparent electrodes. In some implementations, for example, the controllable optical layer can be configured as a controllable optical reflector structured to include a top polarization selective reflector configured to transmit light in a first optical polarization and to reflect light in a second polarization that is orthogonal to the first optical polarization, a liquid crystal layer that is formed below the top polarization selective reflector that responds to an applied voltage as the control signal to change optical polarization between the first and second optical polarizations, and a bottom polarization selective reflector formed on top of the top surface of the transparent slab and configured to transmit light in the first optical polarization and to reflect light in the second polarization that is orthogonal to the first optical polarization. For example, each polarization selective reflector can be configured to include a stack of dielectric films. In some implementations, for example, the lighting device can include a battery power supply to supply electricity to the LED module for emitting the visible light. In some implementations, for example, the lighting device can include a mounting unit for mounting the lighting device to a wall or other surface. In some examples, the LED module and the transparent plate can be engaged to form an illumination plate with LED module being on a first end of the illumination plate; and the lighting device can be structured to further include a support plate having a top plate end and a bottom support end, the top support end being engaged to the illumination plate to allow the support plate and the illumination plate to pivot at different positions relative to each other, and a base plate engaged to the bottom support end of the support plate to allow the support plate and the base plate to pivot at different positions relative to each other, in which the illumination plate, the support plate and base plate collectively form a reconfigurable lighting structure that enables a configuration where the base plate operates as a base to allow the support plate to position the illumination plate over the base plate as a desktop lighting device. For example, the support plate and the illumination plate can be engaged to enable the support plate and the illumination plate to be folded against each other, and the support plate and the base plate are engaged to enable the support plate and the base plate to be folded against each other. In some implementations, for example, the base plate can include a power supply that provides electricity to energize the LED module for emitting the visible light, and the support plate can include an electrically conductive connection to electrically connect the LED module and the power supply to allow the electricity to be transferred to the LED module. In some implementations, for example, the optical layer can be configured as a controllable optical layer that is responsive to a control signal to be optically transparent or optically reflective to light inside the transparent slab, the lighting control mechanism can be coupled to the optical layer to supply the control signal, and the base plate can include a control circuit that generates the control signal to the illumination plate for controlling the controllable optical reflector layer.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Only a few embodiments are described. Other embodiments and their variations and enhancements can be made based on what is described and illustrated.

What is claimed is:

1. A lighting device based on semiconductor light-emitting diodes (LEDs), comprising:

an illumination plate including an LED module having LEDs that emit visible light, an optical plate module including a transparent slab having top and bottom surfaces and a light input side facet between the top and bottom surfaces engaged to the LED module to receive visible light from the LED module, and an optical layer formed on the top surface of the transparent slab to be optically transparent or optically reflective to light inside the transparent slab;

a support plate having a top plate end and a bottom support end, the top support end being engaged to the illumination plate to allow the support plate and the illumination plate to pivot at different positions relative to each other; and a base plate engaged to the bottom support end of the support plate to allow the support plate and the base plate to pivot at different positions relative to each other, wherein the illumination plate, the support plate and base plate collectively form a reconfigurable lighting structure that enables a configuration where the base plate operates as a base to allow the support plate to position the illumination plate over the base plate as a desktop lighting device, wherein the base plate includes a power supply that provides electricity to energize the LED module for emitting the visible light, and the support plate includes an electrically conductive connection to electrically connect the LED module and the power supply to allow the electricity to be transferred to the LED module, wherein:

the optical layer is a controllable optical layer that is responsive to a control signal to be optically transparent or optically reflective to light inside the transparent slab, and the base plate includes a control circuit that generates the control signal to the illumination plate for controlling the controllable optical reflector layer.

2. The lighting device as in claim 1, wherein:

the support plate and the illumination plate are engaged to enable the support plate and the illumination plate to be folded against each other, and the support plate and the base plate are engaged to enable the support plate and the base plate to be folded against each other.

3. The lighting device as in claim 1, wherein:

the controllable optical layer is configured to be (1) optically transparent when the power to the LED module is off and (2) optically reflective when the power to the LED module is on.

4. The lighting device as in claim 1, wherein:

the power supply in the base plate includes one or more batteries.

5. The lighting device as in claim 1, wherein:

the illumination plate includes an optically reflective layer around side edge of the transparent slab to reflect light incident to the edge back to the transparent slab to increase light output at the top or bottom surface.

6. The lighting device as in claim 1, wherein:

the illumination plate includes a metal part in contact with the LED module to dissipate heat out of the LED module.

7. The lighting device as in claim 3, wherein:

the support plate and the illumination plate are engaged to enable the support plate and the illumination plate to be folded against each other, and the support plate and the base plate are engaged to enable the support plate and the base plate to be folded against each other; and the controllable optical layer is controlled to be optically transparent when the illumination plate, the support plate and the base plate are folded together.

8. A lighting device based on semiconductor light-emitting diodes (LEDs), comprising:

an illumination plate including an LED module having LEDs that emit visible light, an optical plate module including a transparent slab having top and bottom surfaces and a light input side facet between the top and bottom surfaces engaged to the LED module to receive visible light from the LED module, and an optical layer formed on the top surface of the transparent slab to be optically transparent or optically reflective to light inside the transparent slab;

a support plate having a top plate end and a bottom support end, the top support end being engaged to the illumination plate to allow the support plate and the illumination plate to pivot at different positions relative to each other; and a base plate engaged to the bottom support end of the support plate to allow the support plate and the base plate to pivot at different positions relative to each other, wherein the illumination plate, the support plate and base plate collectively form a reconfigurable lighting structure that enables a configuration where the base plate operates as a base to allow the support plate to position the illumination plate over the base plate as a desktop lighting device, wherein the base plate includes a power supply that provides electricity to energize the LED module for emitting the visible light, and the support plate includes an electrically conductive connection to electrically connect the LED module and the power supply to allow the electricity to be transferred to the LED module, wherein:

the support plate is made of a transparent or translucent material and includes a transparent electrically conductive material to provide the electrically conductive connection.

9. The lighting device as in claim 8, wherein:

the support plate and the illumination plate are engaged to enable the support plate and the illumination plate to be folded against each other, and the support plate and the base plate are engaged to enable the support plate and the base plate to be folded against each other.

10. The lighting device as in claim 8, wherein:

the illumination plate includes a metal part in contact with the LED module to dissipate heat out of the LED module.

11. A lighting device based on semiconductor light-emitting diodes (LEDs), comprising:

an LED module having LEDs that emit visible light;

a transparent slab having top and bottom surfaces and an input side facet and additional side facets between the top and bottom surfaces, the transparent slab being coupled to the LED module via the input side facet to receive visible light from the LED module;

one or more side facet films formed on the additional side facets of the transparent slab to reflect light exiting the transparent slab via the additional side facets back to the transparent slab so as to enable the transparent slab to direct the received light out of the transparent slab via the top and bottom surfaces;

an optical layer formed on the top surface of the transparent slab to be between (1) a first optical state that is optically transparent or translucent to light in the transparent slab and (2) a second optical state that is optically reflective to light in the transparent slab; and a lighting control mechanism that is coupled to control output of light from the transparent slab based on the first and second optical states of the optical layer with respect to the light inside the transparent slab to either output light via both top and bottom surfaces when the optical layer is in the first optical state to the light or to output light via only the bottom surface when the optical layer is in the second optical state to the light.

12. The lighting device as in claim 11, wherein:

the optical layer includes a stack of dielectric films configured to transmit light in a first optical polarization and to reflect light in a second polarization that is orthogonal to the first optical polarization, and the lighting control mechanism controls an optical polarization of light inside the transparent slab to be in either the first optical polarization or in the second polarization.

13. The lighting device as in claim 11, wherein:

the optical layer is a controllable optical layer that changes between the first and second optical states in response to a control signal applied to the controllable optical layer, and the lighting control mechanism is coupled to the optical layer to supply the control signal.

14. The lighting device as in claim 11, comprising:

a battery power supply to supply electricity to the LED module for emitting the visible light.

15. The lighting device as in claim 11, wherein:

the LED module and the transparent plate are engaged to form an illumination plate with LED module being on a first end of the illumination plate; and the lighting device further includes:

a support plate having a top plate end and a bottom support end, the top support end being engaged to the illumination plate to allow the support plate and the illumination plate to pivot at different positions relative to each other; and a base plate engaged to the bottom support end of the support plate to allow the support plate and the base plate to pivot at different positions relative to each other, wherein the illumination plate, the support plate and base plate collectively form a reconfigurable lighting structure that enables a configuration where the base plate operates as a base to allow the support plate to position the illumination plate over the base plate as a desktop lighting device.

16. The lighting device as in claim 13, wherein:

the controllable optical layer includes a liquid crystal layer that responds to an applied voltage as the control signal to change between the first and second optical states.

17. The lighting device as in claim 13, wherein:

the controllable optical layer is a controllable optical diffuser which includes:

a top transparent electrode;

a light diffusing layer that is below the top transparent electrode that responds to an applied voltage as the control signal to change an amount of diffusion of light based on the applied voltage; and a bottom transparent electrode formed below the light diffusing layer which is located between the bottom and top transparent electrodes.

18. The lighting device as in claim 13, wherein:

the controllable optical layer is a controllable optical reflector which includes:

a top polarization selective reflector configured to transmit light in a first optical polarization and to reflect light in a second polarization that is orthogonal to the first optical polarization;

a liquid crystal layer that is formed below the top polarization selective reflector that responds to an applied voltage as the control signal to change optical polarization between the first and second optical polarizations; and a bottom polarization selective reflector formed on top of the top surface of the transparent slab and configured to transmit light in the first optical polarization and to reflect light in the second polarization that is orthogonal to the first optical polarization.

19. The lighting device as in claim 14, comprising:

a mounting unit for mounting the lighting device to a wall or other surface.

20. The lighting device as in claim 15, wherein:

the support plate and the illumination plate are engaged to enable the support plate and the illumination plate to be folded against each other, and the support plate and the base plate are engaged to enable the support plate and the base plate to be folded against each other.

21. The lighting device as in claim 18, wherein:

each polarization selective reflector includes a stack of dielectric films.

22. The lighting device as in claim 20, wherein:

the base plate includes a power supply that provides electricity to energize the LED module for emitting the visible light, and the support plate includes an electrically conductive connection to electrically connect the LED module and the power supply to allow the electricity to be transferred to the LED module.

23. The lighting device as in claim 22, wherein:

the optical layer is a controllable optical layer that is responsive to a control signal to be optically transparent or optically reflective to light inside the transparent slab;

the lighting control mechanism is coupled to the optical layer to supply the control signal; and the base plate includes a control circuit that generates the control signal to the illumination plate for controlling the controllable optical reflector layer.

* * * * *